US007891466B2

(12) United States Patent
Okamoto et al.

(10) Patent No.: US 7,891,466 B2
(45) **Date of Patent: *Feb. 22, 2011**

(54) ELEVATOR APPARATUS FOR EMERGENCY BRAKING

(75) Inventors: Ken-Ichi Okamoto, Tokyo (JP); Satoru Takahashi, Tokyo (JP); Takaharu Ueda, Tokyo (JP); Masunori Shibata, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 195 days.

This patent is subject to a terminal disclaimer.

(21) Appl. No.: 11/794,198

(22) PCT Filed: Mar. 17, 2006

(86) PCT No.: PCT/JP2006/305409

§ 371 (c)(1),
(2), (4) Date: Jun. 26, 2007

(87) PCT Pub. No.: WO2007/108069

PCT Pub. Date: Sep. 27, 2007

(65) Prior Publication Data

US 2010/0025162 A1 Feb. 4, 2010

(51) Int. Cl.
*B66B 1/32* (2006.01)

(52) U.S. Cl. ..... 187/288; 187/287

(58) Field of Classification Search ..... 187/247, 187/277, 288, 290, 293, 296, 391–393, 287, 187/291, 351

See application file for complete search history.

(56) References Cited

U.S. PATENT DOCUMENTS

| | | | | |
|---|---|---|---|---|
| 4,974,703 | A * | 12/1990 | Nomura | 187/288 |
| 5,407,028 | A * | 4/1995 | Jamieson et al. | 187/288 |
| 6,173,814 | B1 * | 1/2001 | Herkel et al. | 187/288 |
| 6,422,350 | B1 * | 7/2002 | Erker | 187/277 |
| 7,228,943 | B2 * | 6/2007 | Kugiya et al. | 187/393 |
| 7,730,998 | B2 * | 6/2010 | Takahashi et al. | 187/288 |
| 2004/0173413 | A1 | 9/2004 | Angst et al. | |
| 2006/0237265 | A1 * | 10/2006 | Eckenstein et al. | 187/391 |
| 2009/0266649 | A1 * | 10/2009 | Kondo et al. | 187/288 |
| 2010/0032245 | A1 * | 2/2010 | Shibata et al. | 187/288 |

FOREIGN PATENT DOCUMENTS

| | | |
|---|---|---|
| BR | 0210750 A | 7/2004 |
| CA | 2 448 538 | 1/2003 |
| CN | 1524057 A | 8/2004 |
| EP | 1401757 A1 | 3/2004 |
| JP | 57-85779 | 5/1982 |
| JP | 3 3874 | 1/1991 |
| JP | 7 157211 | 6/1995 |
| JP | 8-91753 | 4/1996 |
| JP | 9-240936 | 9/1997 |
| JP | 2004 231355 | 8/2004 |
| JP | 2005-515134 | 5/2005 |
| WO | WO 03/004397 A1 | 1/2003 |

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

In an elevator apparatus, a brake device stops a car from running. The brake device has a brake control portion for controlling a braking force generated at a time of emergency braking to adjust a deceleration of the car, and a timer circuit for invalidating the control of the braking force performed by the brake control portion after a lapse of a predetermined time from a moment when an emergency braking command is generated.

5 Claims, 10 Drawing Sheets

ELEVATOR APPARATUS FOR EMERGENCY BRAKING

TECHNICAL FIELD

The present invention relates to an elevator apparatus allowing the deceleration of a car at a time of emergency braking to be adjusted.

BACKGROUND ART

In a conventional brake device for an elevator, the braking force of an electromagnetic brake is controlled at the time of emergency braking such that the deceleration of a car becomes equal to a predetermined value, based on a deceleration command value and a speed signal (for example, see Patent Document 1).

Patent Document 1: JP 07-157211 A

DISCLOSURE OF THE INVENTION

Problem to be Solved by the Invention

In the conventional brake device as described above and a braking control device, however, the basic operation of emergency braking and the control of a braking force are both performed by a single braking force control unit. Therefore, in a case where the deceleration of the car is excessively low owing to a malfunction in the braking force control unit or the like, the breaking distance becomes excessively large.

The present invention has been made to solve the above-mentioned problem, and it is therefore an object of the present invention to obtain an elevator apparatus allowing the car to be stopped more reliably even in the event of a malfunction in a brake control portion while suppressing the deceleration at the time of emergency braking.

Means for Solving the Problems

An elevator apparatus according to the present invention includes: a car; and a brake device for stopping the car from running, in which the brake device has a brake control portion for controlling a braking force generated at a time of emergency braking to adjust a deceleration of the car; and a timer circuit for invalidating control of the braking force performed by the brake control portion after a lapse of a predetermined time from a moment when an emergency braking command is generated.

BEST MODES FOR CARRYING OUT THE INVENTION

Preferred embodiments of the present invention will be described hereinafter with reference to the drawings.

Embodiment 1

Figure 1:
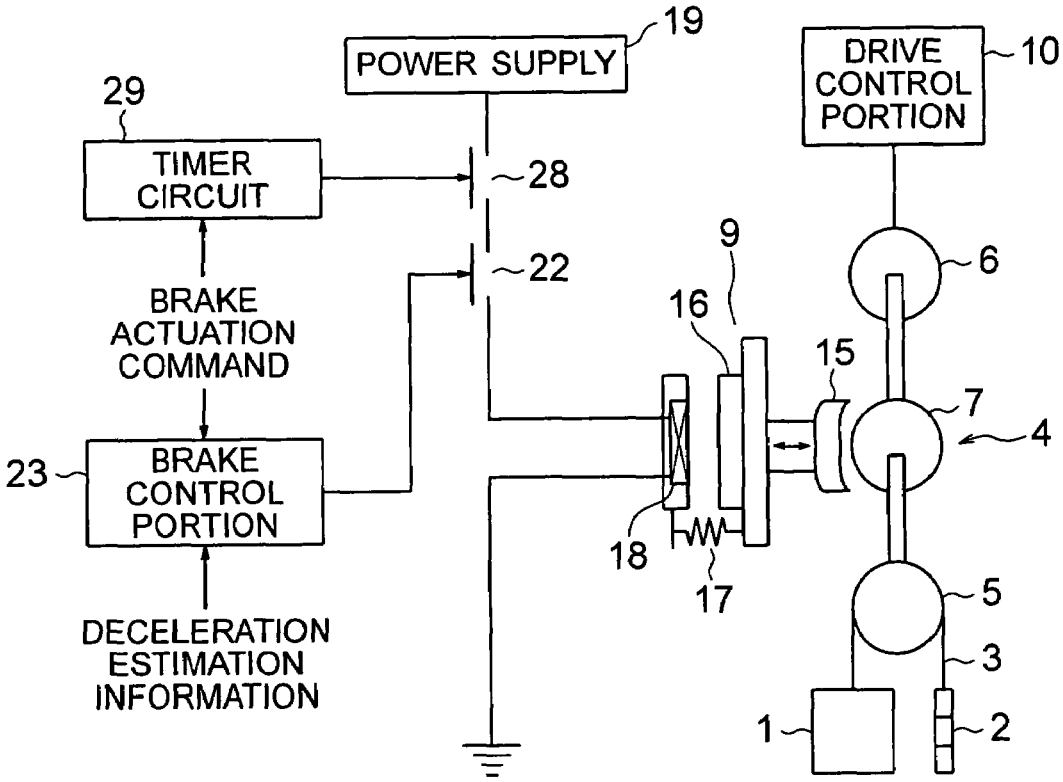
FIG. 1 is a schematic diagram showing an elevator apparatus according to Embodiment 1 of the present invention.

FIG. 1 is a schematic diagram showing an elevator apparatus according to Embodiment 1 of the present invention. Referring to FIG. 1, a car 1 and a counterweight 2 are suspended within a hoistway by a main rope 3. The car 1 and the counterweight 2 are raised/lowered within the hoistway due to a driving force of a hoisting machine 4.

The hoisting machine 4 has a drive sheave 5 around which the main rope 3 is looped, a motor 6 for rotating the drive sheave 5, a brake drum 7 as a brake rotational body that is rotated integrally with the drive sheave 5 as the car 1 runs, and a brake portion body 9 for braking rotation of the drive sheave 5. The driving of the motor 6 is controlled by a drive control portion 10 as an operation control portion.

The brake portion body 9 has a brake shoe 15 that is brought into contact with and away from the brake drum 7, an armature 16 mounted on the first brake shoe 15, a braking spring 17 for pressing the brake shoe 15 against the brake drum 7, and a brake coil 18 disposed facing the armature 16 to generate an electromagnetic force for opening the brake shoe 15 away from the brake drum 7 against the braking spring 17.

A brake switch 22 and a timer switch 28 are connected in series between the brake coil 18 and a power supply 19. By opening at least one of the switches 22 and 28, the supply of a power to the brake coil 18 is shut off, so the brake shoe 15 is pressed against the brake drum 7 by the braking spring 17. The timer switch 28 is normally closed. Accordingly, during normal operation, when the brake switch 22 is closed, the brake coil 18 is thereby supplied with a power, so the brake shoe 15 is opened away from the brake drum 7.

The turning ON/OFF of the brake switch 22 is controlled by a brake control portion 23. The brake control portion 23 is constituted by a microcomputer having a calculation processing portion (a CPU), a storage portion (a ROM, a RAM, and the like), and signal input/output portions.

When a brake actuation command (including a normal braking command and an emergency braking command) is generated, the brake control portion 23 opens the brake switch 22, and shuts off the supply of a current to the brake coil 18 to cause the brake portion body 9 to perform braking operation. When the brake actuation command is canceled, namely, when a brake opening command is generated, the brake control portion 23 closes the brake switch 22 to cancel a braking force of the brake portion body 9. The brake actuation command and the brake opening command are generated by an elevator control portion including the drive control portion 10, and then input to the brake control portion 23.

When a brake actuation command, namely, an emergency braking command is generated while the car 1 is running, the brake control portion 23 estimates a deceleration (the absolute value of a negative acceleration) of the car 1 based on deceleration estimation information for estimating the deceleration of the car 1, and controls an electromagnetic force generated by the brake coil 18 (an open/closed state of the brake switch 22) such that the deceleration of the car 1 does not become excessively high or low. Thus, the brake control portion 23 controls a pressing force with which the brake shoe 15 is pressed against the brake drum 7.

Available as the deceleration estimation information is information from a hoisting machine rotation detector for detecting rotation of the motor 6, a car position detector provided on a speed governor, a return pulley rotation detector for detecting rotation of a return pulley around which the main rope 3 is looped, a weighing device for detecting a load within the car 1, a speedometer mounted on the car 1, an accelerometer mounted on the car 1, an axial torque meter for detecting an axial torque of the drive sheave 5, or the like. Employable as the rotation detectors and the car position detector are encoders or resolvers.

Employed as the second brake switch 22 is a switch allowing the amount of the current supplied to the brake coil 18 to be adjusted, for example, an open/close switch capable of chopping or a slide switch for continuously changing a resistance value. The following description of Embodiment 1 of the present invention will be given as to a case where the open/close switch is employed. However, in a case where the slide switch is employed, the switch is slid to change the resistance value instead of being turned ON/OFF.

The timer switch 28 is opened in response to an opening command from a timer circuit 29. When a brake actuation command is generated, the timer circuit 29 starts measuring (counting down) a time, and outputs the opening command to the timer switch 28 after the lapse of a predetermined time from a moment when the brake actuation command is generated. Accordingly, the control of the braking force of the brake portion body 9 performed by the brake control portion 23 is invalidated after the lapse of a predetermined time from a moment when an emergency braking command is generated.

When the brake actuation command is canceled, the measurement of the time by the timer circuit 29 is reset, so the timer switch 28 is closed. A brake device in Embodiment 1 of the present invention has the brake portion body 9, the brake switch 22, the brake control portion 23, the timer switch 28, and the timer circuit 29.

In the elevator apparatus structured as described above, the control of braking force performed by the brake control portion 23 is invalidated after the lapse of the predetermined time from the moment when the emergency braking command is generated. It is therefore possible to stop the car 1 more reliably even in the event of a malfunction in the brake control portion 23 while suppressing the deceleration of the car 1 at the time of emergency braking.

Embodiment 2

Figure 2:
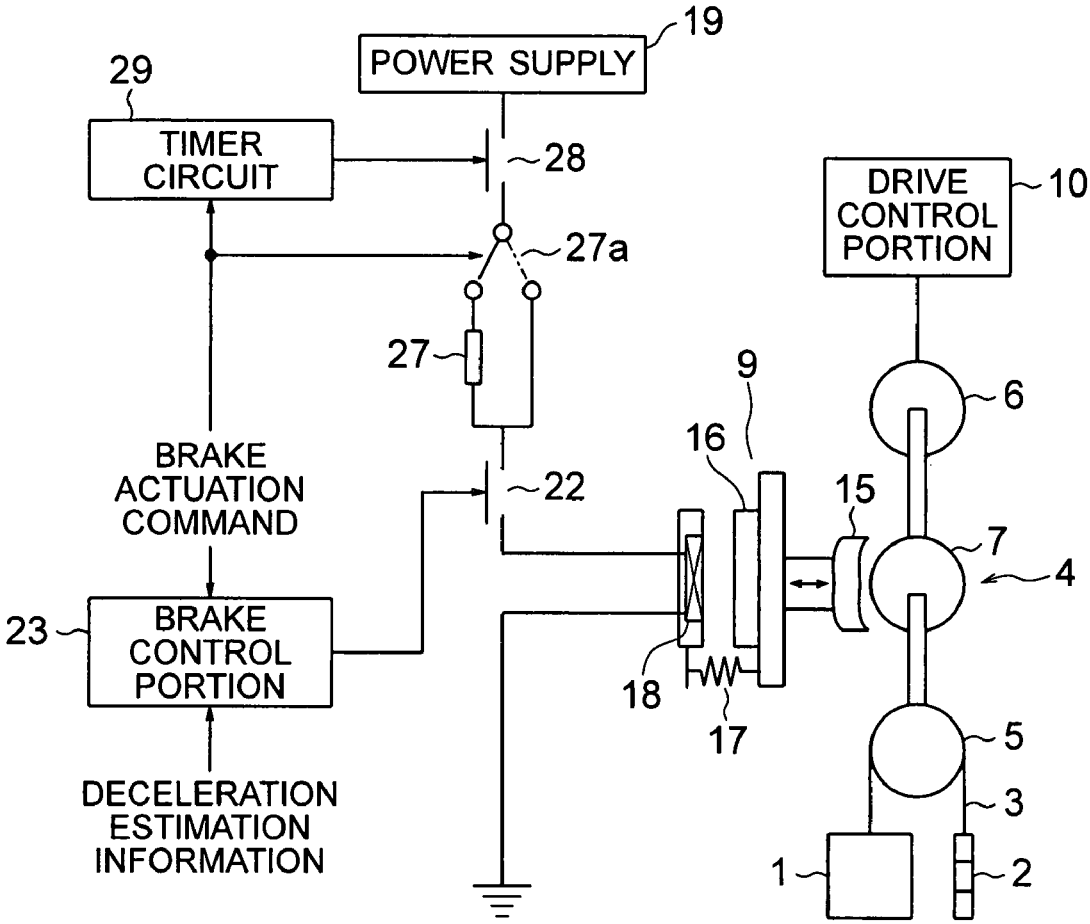
FIG. 2 is a schematic diagram showing an elevator apparatus according to Embodiment 2 of the present invention.

Next, FIG. 2 is a schematic diagram showing an elevator apparatus according to Embodiment 2 of the present invention. Referring to FIG. 2, a current limiter 27 and a changeover switch 27*a* are connected between the brake coil 18 and the power supply 19. The current limiter 27 limits the current flowing through the brake coil 18. Employed as the current limiter 27 is, for example, a resistor. The changeover switch 27*a* makes a changeover between an operation of limiting a current from the power supply 19 by means of the current limiter 27 to supply the brake coil 18 with the limited current and an operation of supplying the brake coil 18 with the current from the power supply 19 without the intermediation of the current limiter 27.

More specifically, the changeover switch 27*a* has normally been changed over to a circuit side from which the current limiter 27 is excluded. In this state, when a brake actuation command is generated, the changeover switch 27*a* is changed over to a circuit side including the current limiter 27. When the brake actuation command is canceled, the changeover switch 27*a* is returned to the circuit side from which the current limiter 27 is excluded. Embodiment 2 of the present invention is identical to Embodiment 1 of the present invention in other configurational details and other operational details.

In the elevator apparatus structured as described above, the current limiter 27 is employed to set an upper limit of the amount of the current supplied to the brake coil 18 which can be controlled by the brake control portion 23, so only part of a power-supply voltage is applied to the brake coil 18. Accordingly, it is possible to suitably limit the amount of the control of the brake portion body 9 performed by the brake control portion 23.

Embodiment 3

Figure 3:
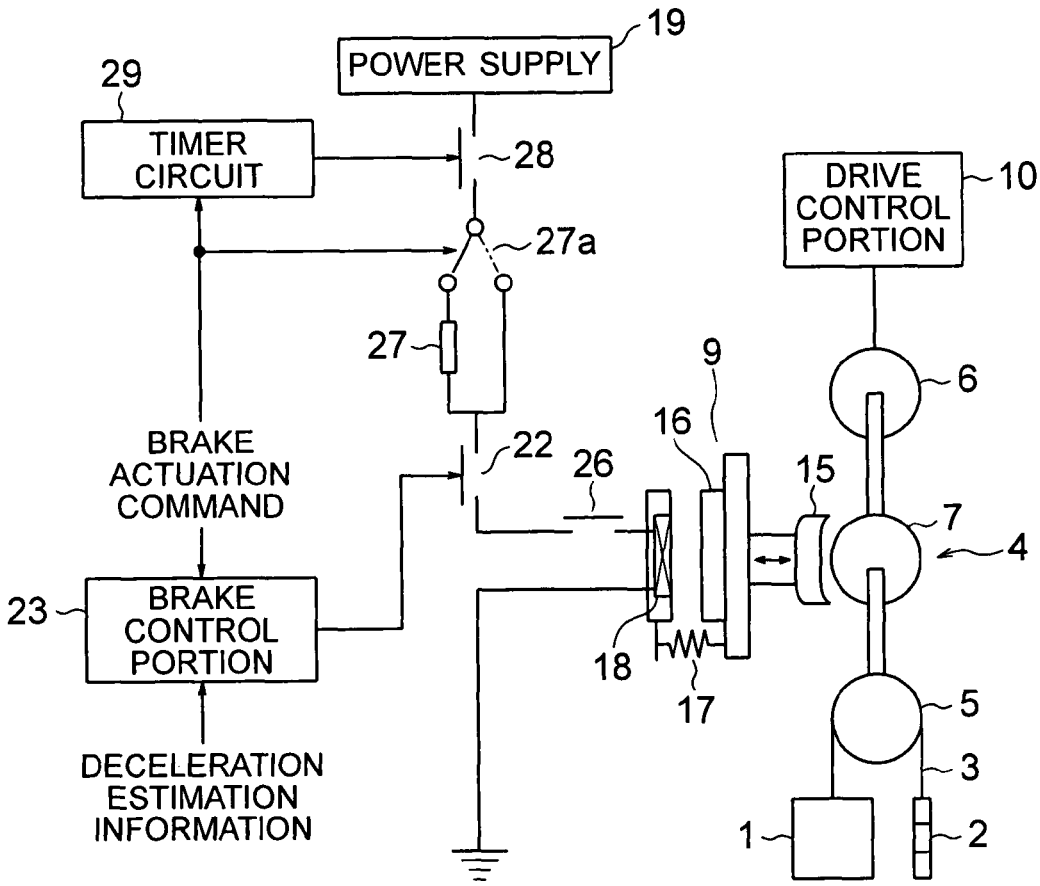
FIG. 3 is a schematic diagram showing an elevator apparatus according to Embodiment 3 of the present invention.

Next, FIG. 3 is a schematic diagram showing an elevator apparatus according to Embodiment 3 of the present invention. Referring to FIG. 3, a forcible braking switch 26 is provided between the brake coil 18 and the power supply 19. The forcible braking switch 26 is connected in series to the brake switch 22 and is normally closed. By opening the forcible braking switch 26, the brake portion body 9 is forced to perform braking operation regardless of a command from the brake control portion 23. That is, the forcible braking switch 26 invalidates the control of braking force performed by the brake control portion 23 in response to an external signal, thereby forcing the brake portion body 9 to generate a total braking force. Embodiment 3 of the present invention is identical to Embodiment 2 of the present invention in other configurational details and other operational details.

In the elevator apparatus structured as described above, the forcible braking switch 26 is provided between the brake coil 18 and the power supply 19. It is therefore possible to invalidate the control performed by the brake control portion 23 according to need and cause the brake portion body 9 to perform braking operation immediately.

Embodiment 4

Figure 4:
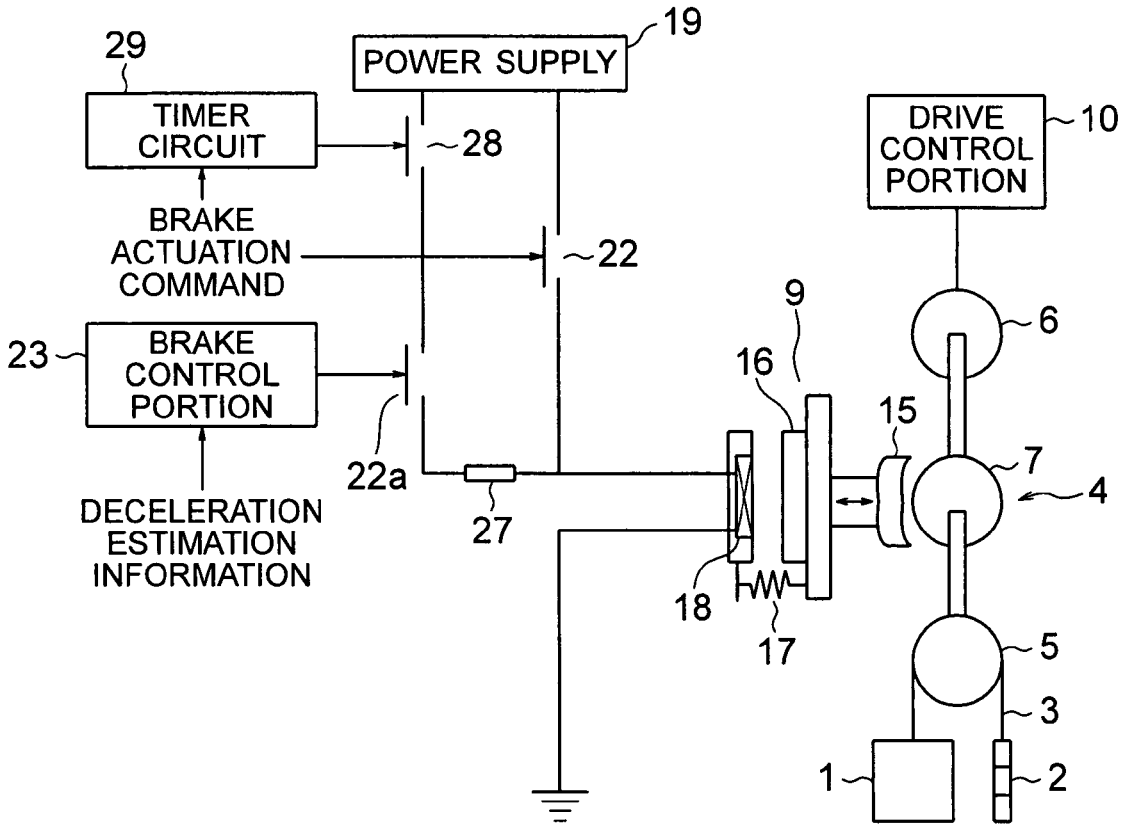
FIG. 4 is a schematic diagram showing an elevator apparatus according to Embodiment 4 of the present invention.

Next, FIG. 4 is a schematic diagram showing an elevator apparatus according to Embodiment 4 of the present invention. Referring to FIG. 4, the brake switch 22 is directly opened/closed depending on whether or not there is a brake actuation command (brake opening command), without being controlled by the brake control portion 23. An adjustment switch 22*a*, the current limiter 27, and the timer switch 28 are connected in parallel with the brake switch 22 between the power supply 19 and the brake coil 18.

In this example, a normal open/close switch is employed as the brake switch 22. Employed as the adjustment switch 22*a* is a switch allowing the amount of the current supplied to the brake coil 18 to be adjusted, for example, an open/close switch capable of chopping or a slide switch for continuously changing a resistance value. During normal operation, the adjustment switch 22*a* is open, and the timer switch 28 is closed. The following description of Embodiment 4 of the present invention will be given as to a case where the open/close switch is employed. However, in a case where the slide switch is employed, the switch is slid to change the resistance value instead of being turned ON/OFF.

The turning ON/OFF of the adjustment switch 22*a* is controlled by the brake control portion 23. More specifically, the brake control portion 23 monitors the deceleration of the car 1 during the running thereof regardless of whether or not there is a brake actuation command, and controls an electromagnetic force generated by the second brake coil 18, namely, an open/close state of the adjustment switch 22*a* such that the deceleration of the car 1 does not become excessively high or low. The timer switch 28 is opened after the lapse of a predetermined time from a moment when a brake actuation command is generated. The brake control portion 23 detects and monitors the deceleration of the car 1 independently of the drive control portion 10. Embodiment 4 of the present invention is identical to Embodiment 1 of the present invention in other configurational details and other operational details.

In the elevator apparatus structured as described above, the adjustment switch 22*a* for adjusting a braking force is disposed in parallel with the brake switch 22 in a circuit, and the brake switch 22 is opened immediately in response to a brake actuation command. It is therefore possible to cause the brake portion body 9 to perform braking operation immediately without an operational delay when the brake actuation command is generated.

The brake control portion 23 detects and monitors the deceleration of the car 1 independently of the drive control portion 10. It is therefore possible to improve the reliability.

Embodiment 5

Figure 5:
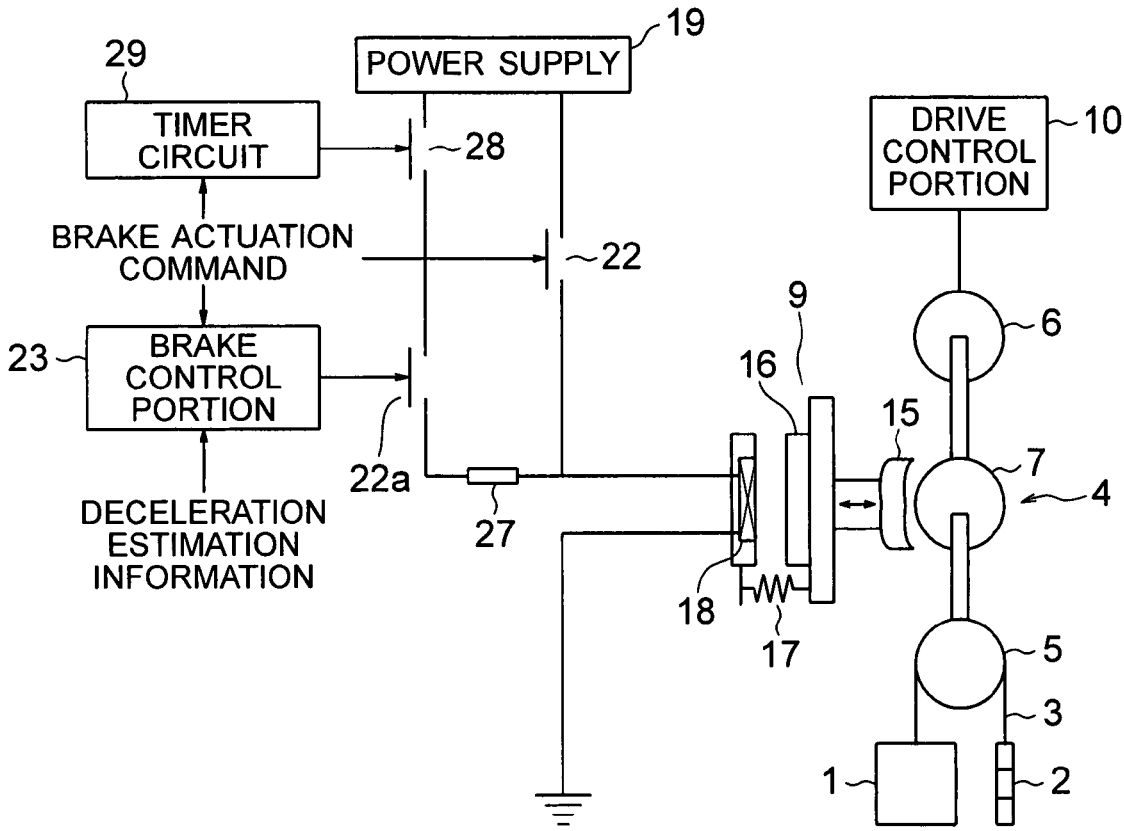
FIG. 5 is a schematic diagram showing an elevator apparatus according to Embodiment 5 of the present invention.

Next, FIG. 5 is a schematic diagram showing an elevator apparatus according to Embodiment 5 of the present invention. Referring to FIG. 5, a brake actuation command is also input to the brake control portion 23. When the brake actuation command is input to the brake control portion 23, the brake control portion 23 monitors the deceleration of the car 1 during the running thereof, and controls an electromagnetic force generated by the brake coil 18, namely, an open/closed state of the adjustment switch 22*a* such that the deceleration of the car 1 does not become excessively high or low. Embodiment 5 of the present invention is identical to Embodiment 4 of the present invention in other configurational details.

As described above, it is also appropriate to allow the brake control portion 23 to control the deceleration of the car 1 only when the brake actuation command is generated.

Embodiment 6

Figure 6:
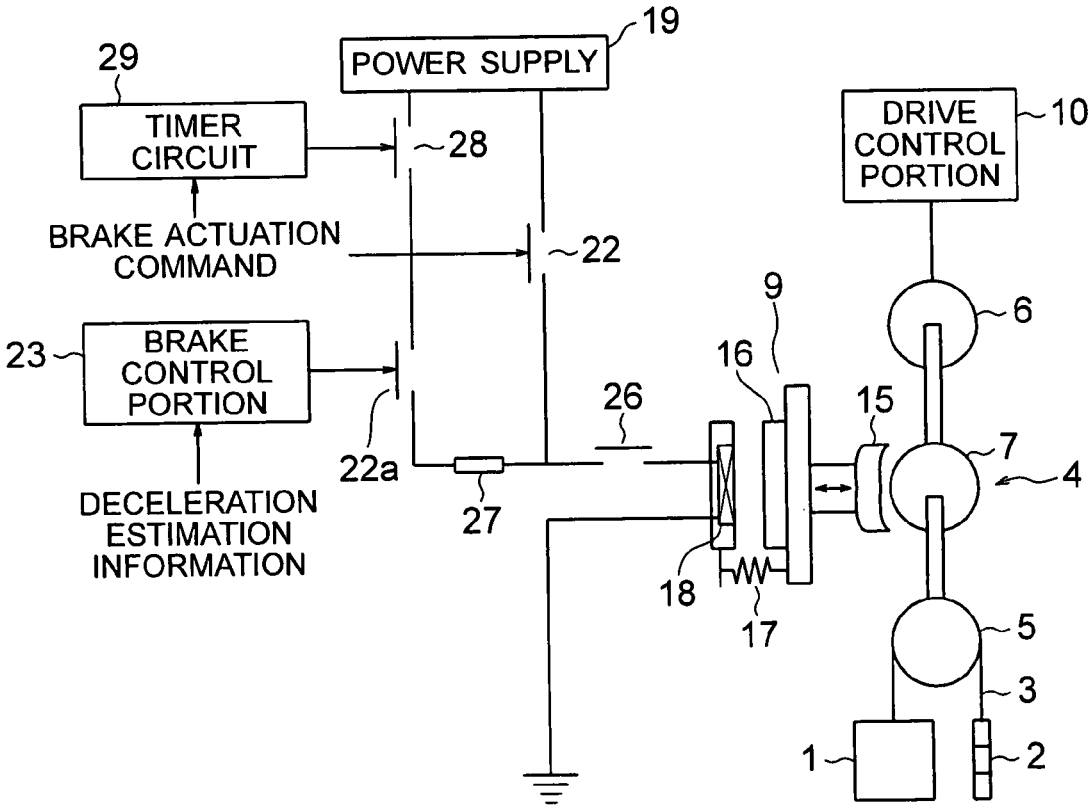
FIG. 6 is a schematic diagram showing an elevator apparatus according to Embodiment 6 of the present invention.

Next, FIG. 6 is a schematic diagram showing an elevator apparatus according to Embodiment 6 of the present invention. Referring to FIG. 6, the forcible braking switch 26 is provided between the brake coil 18 and the power supply 19. The forcible braking switch 26 is normally closed. By opening the forcible braking switch 26, the brake portion body 9 is forced to perform braking operation regardless of a command from the brake control portion 23 and an open/closed state of the brake switch 22. Embodiment 6 of the present invention is identical to Embodiment 4 of the present invention in other configurational details and other operational details.

In the elevator apparatus structured as described above, the forcible braking switch 26 is provided between the brake coil 18 and the power supply 19. It is therefore possible to invalidate the control performed by the brake control portion 23 according to need.

It is also appropriate to input a brake actuation command to the brake control portion 23 and allow the brake control portion 23 to control the deceleration of the car 1 only when the brake actuation command is generated.

Embodiment 7

Figure 7:
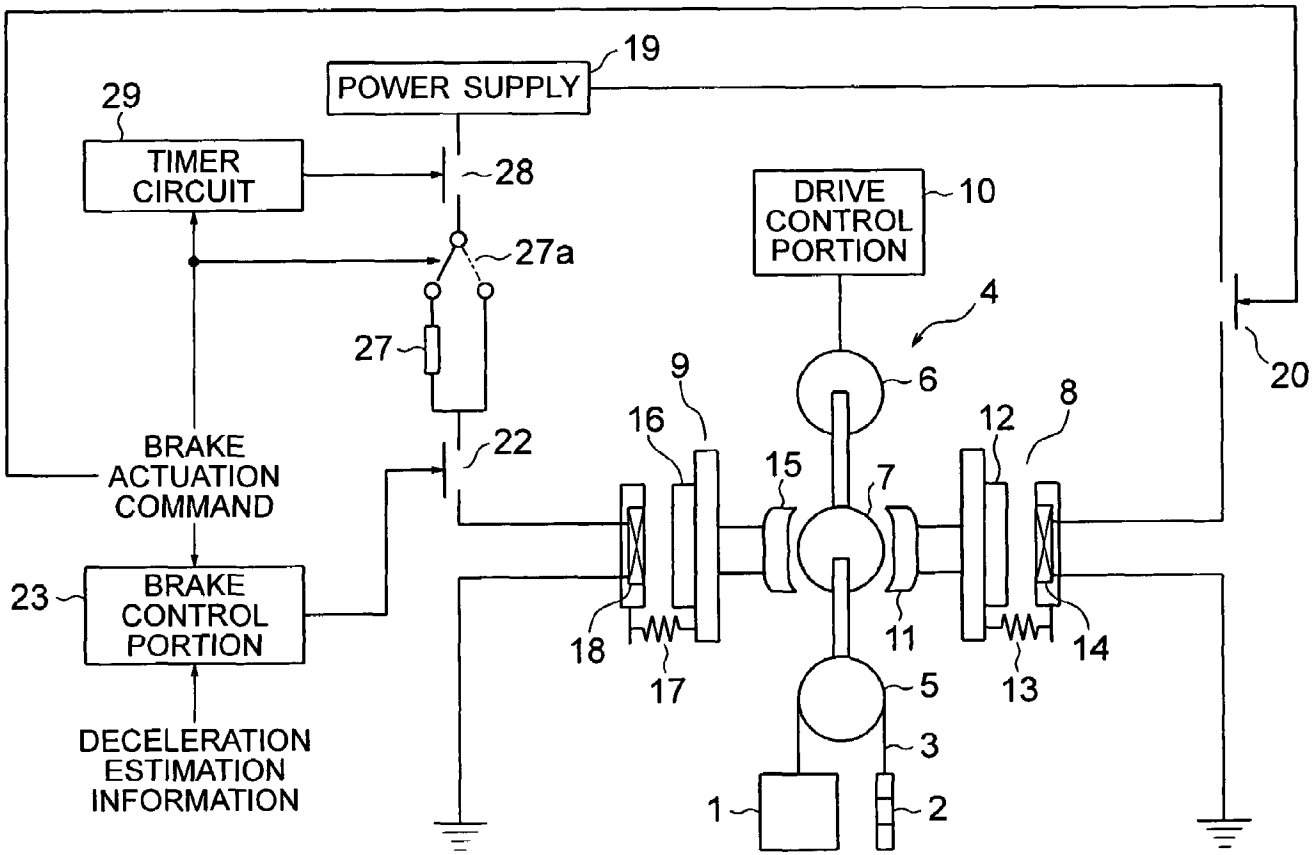
FIG. 7 is a schematic diagram showing an elevator apparatus according to Embodiment 7 of the present invention.

Next, FIG. 7 is a schematic diagram showing an elevator apparatus according to Embodiment 7 of the present invention. Referring to FIG. 7, the hoisting machine 4 has the drive sheave 5, the motor 6, the brake drum 7, a first brake portion body 8 for braking rotation of the drive sheave 5, and a second brake portion body 9 for braking rotation of the drive sheave 5.

The first brake portion body 8 has a first brake shoe 11 that is moved into contact with and away from the brake drum 7, a first armature 12 mounted on the first brake shoe 11, a first braking spring 13 for pressing the first brake shoe 11 against the brake drum 7, and a first brake coil 14 disposed facing the first armature 12 to generate an electromagnetic force for opening the first brake shoe 11 away from the brake drum 7 against the first braking spring 13.

The second brake portion body 9, which corresponds to the brake portion body 9 in Embodiment 2 of the present invention, has a second brake shoe 15, a second armature 16, a second braking spring 17, and a second brake coil 18.

A first brake switch 20 is provided between the first brake coil 14 and the power supply 19. The first brake switch 20 is directly opened/closed depending on whether or not there is a brake actuation command. When the brake actuation command is generated, the first brake switch 20 is opened to shut off the supply of a power to the first brake coil 14, so the first brake shoe 11 is pressed against the brake drum 7 by the first braking spring 13. When a brake opening command is generated, the first brake switch 20 is closed, so the braking force of the first brake portion body 8 is canceled.

The second brake switch 22 corresponds to the brake switch 22 in Embodiment 2 of the present invention. That is, the turning ON/OFF of the second brake switch 22 is controlled by the brake control portion 23. The first brake portion body 8 has a sufficient braking force to stop the car 1 even when the braking force exerted by the second brake portion body 9 remains canceled.

A brake device in Embodiment 7 of the present invention has the first brake portion body 8, the second brake portion body 9, the first brake switch 20, the second brake switch 22, the brake control portion 23, the current limiter 27, the changeover switch 27*a*, the timer switch 28, and the timer circuit 29. Embodiment 7 of the present invention is identical to Embodiment 2 of the present invention in other configurational details and other operational details.

In the elevator apparatus structured as described above, when a brake actuation command is generated, the first brake portion body 8 performs braking operation immediately regardless of the control state of the second brake portion body 9. It is therefore possible to prevent a delay in starting braking operation more reliably.

In Embodiment 7 of the present invention, the second brake portion body 9 first performs braking operation when a brake actuation command is generated, and reduces a braking force when the deceleration of the car 1 becomes excessively high. However, it is also appropriate to keep the second brake switch 22 closed even when a brake actuation command is generated, and open the second brake switch 22 to perform braking operation when the deceleration of the car 1 is equal to or lower than a predetermined value.

Embodiment 8

Figure 8:
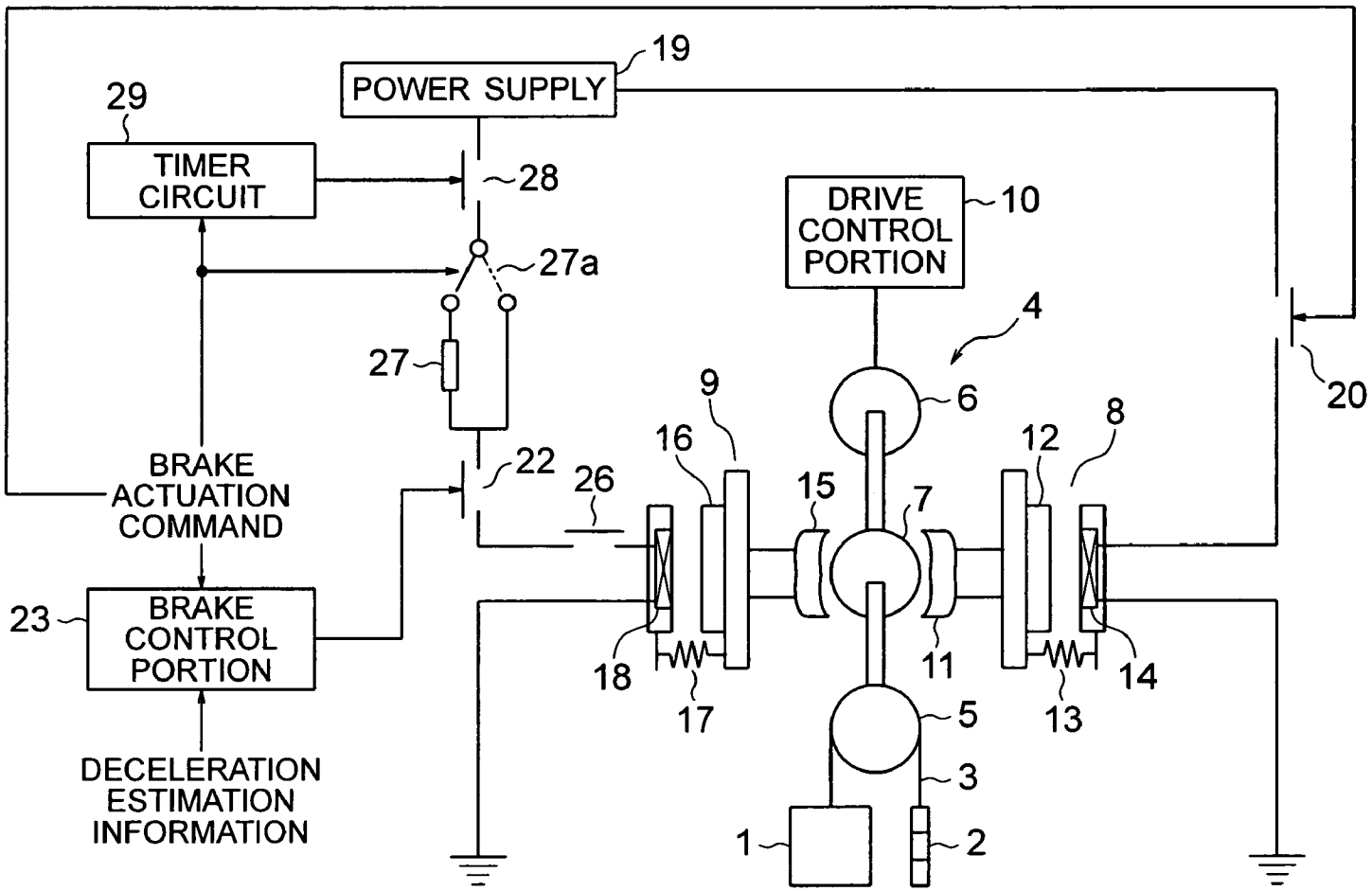
FIG. 8 is a schematic diagram showing an elevator apparatus according to Embodiment 8 of the present invention.

Next, FIG. 8 is a schematic diagram showing an elevator apparatus according to Embodiment 8 of the present invention. Referring to FIG. 8, the forcible braking switch 26 is provided between the second brake coil 18 and the power supply 19. The forcible braking switch 26 is normally closed. By opening the forcible braking switch 26, the second brake portion body 9 is forced to perform braking operation regardless of a command from the brake control portion 23. Embodiment 8 of the present invention is identical to Embodiment 7 of the present invention in other configurational details and other operational details.

In the elevator apparatus structured as described above, the forcible braking switch 26 is provided between the brake coil 18 and the power supply 19. It is therefore possible to invalidate the control performed by the brake control portion 23 according to need.

Embodiment 9

Figure 9:
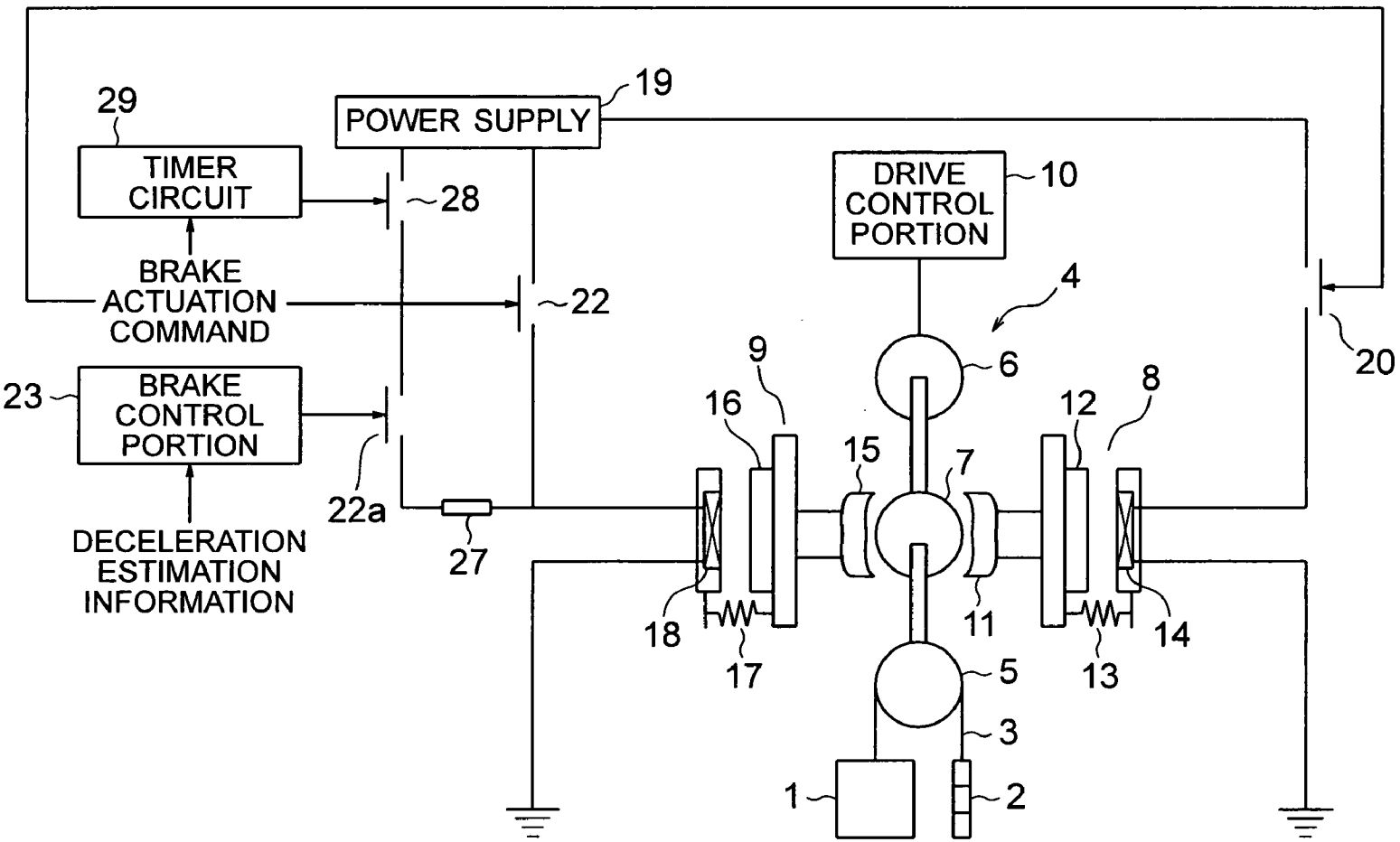
FIG. 9 is a schematic diagram showing an elevator apparatus according to Embodiment 9 of the present invention.

Next, FIG. 9 is a schematic diagram showing an elevator apparatus according to Embodiment 9 of the present invention. Referring to FIG. 9, the hoisting machine 4 has the drive sheave 5, the motor 6, the brake drum 7, the first brake portion body 8 for braking rotation of the drive sheave 5, and the second brake portion body 9 for braking rotation of the drive sheave 5.

The first brake portion body 8 has the first brake shoe 11, the first armature 12, the first braking spring 13, and the first brake coil 14 as in the cases of Embodiments 7 and 8 of the present invention. The second brake portion body 9, which corresponds to the brake portion body 9 in Embodiment 4 of the present invention, has the second brake shoe 15, the second armature 16, the second braking spring 17, and the second brake coil 18.

The first brake switch 20 is provided between the first brake coil 14 and the power supply 19. The first brake switch 20 is directly opened/closed depending on whether or not there is a brake actuation command.

The second brake switch 22 corresponds to the brake switch 22 in Embodiment 4 of the present invention. That is, the second brake switch 22 is directly opened/closed depending on whether or not there is a brake actuation command, without being controlled by the brake control portion 23. The adjustment switch 22*a*, the current limiter 27, and the timer switch 28 are connected in parallel with the second brake switch 22 between the power supply 19 and the second brake coil 18.

The turning ON/OFF of the adjustment switch 22*a* is controlled by the brake control portion 23. More specifically, the brake control portion 23 monitors the deceleration of the car 1 during the running thereof regardless of whether or not there is a brake actuation command, and controls an electromagnetic force generated by the second brake coil 18, namely, an open/closed state of the adjustment switch 22*a* such that the deceleration of the car 1 does not become excessively high or low. The timer switch 28 is opened after the lapse of a predetermined time from a moment when the brake actuation command is generated.

A brake device in Embodiment 9 of the present invention has the first brake portion body 8, the second brake portion body 9, the first brake switch 20, the second brake switch 22, the adjustment switch 22*a*, the brake control portion 23, the current limiter 27, the timer switch 28, and the timer circuit 29. Embodiment 9 of the present invention is identical to Embodiments 4 and 7 of the present invention in other configurational details and other operational details.

In the elevator apparatus structured as described above, when a brake actuation command is generated, the first brake portion body 8 performs braking operation immediately regardless of the control state of the second brake portion body 9. It is therefore possible to prevent a delay in starting braking operation more reliably.

The adjustment switch 22*a* for adjusting a braking force is disposed in parallel with the second brake switch 22 in a circuit, and the second brake switch 22 is directly opened/closed depending on whether or not there is a brake actuation command. It is therefore possible to cause the second brake portion body 9 to perform braking operation immediately without an operational delay when the brake actuation command is generated.

It is also appropriate to input a brake actuation command to the brake control portion 23, and allow the brake control portion 23 to control the deceleration of the car 1 only when the brake actuation command is generated.

Embodiment 10

Figure 10:
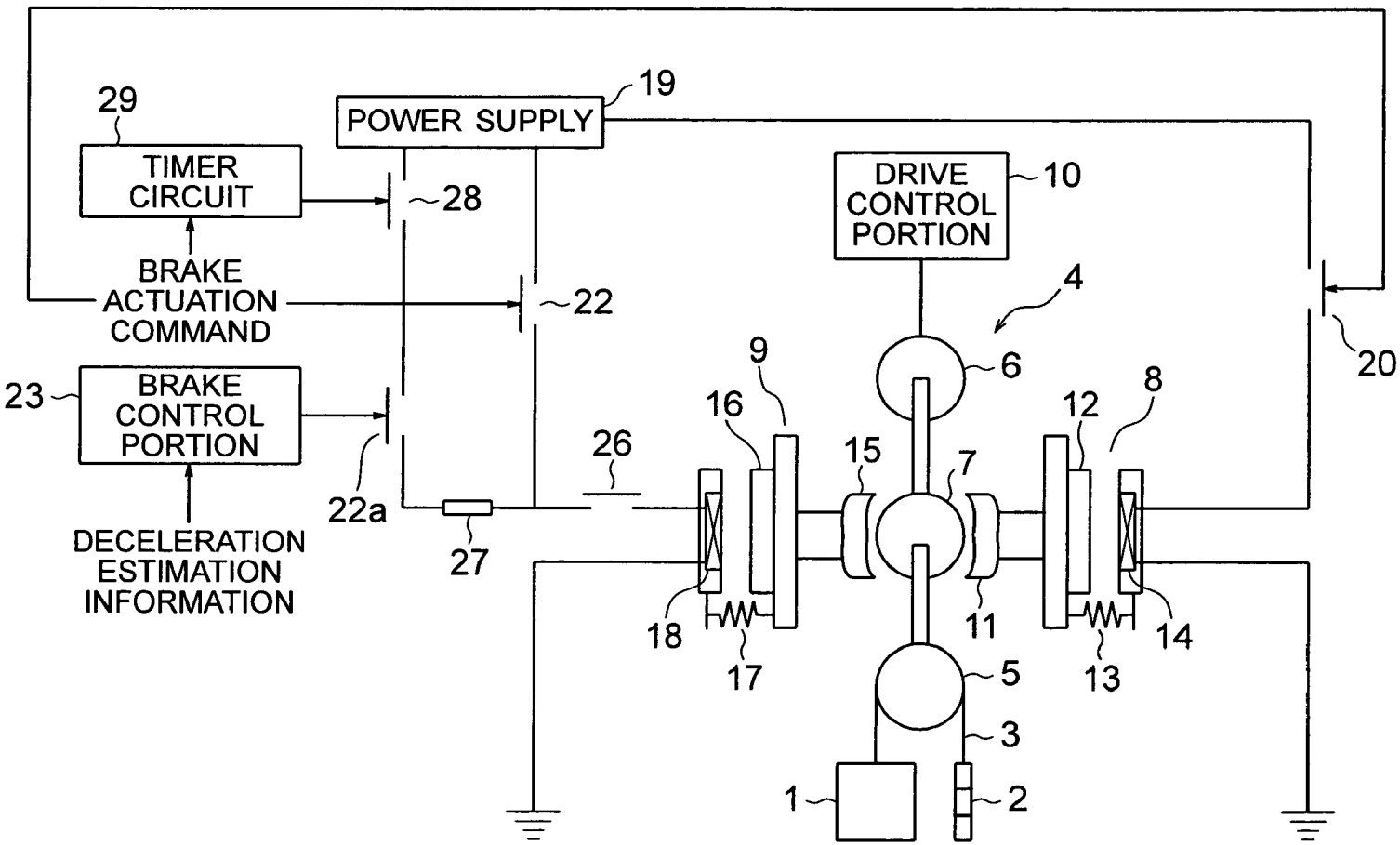
FIG. 10 is a schematic diagram showing an elevator apparatus according to Embodiment 10 of the present invention.

Next, FIG. 10 is a schematic diagram showing an elevator apparatus according to Embodiment 10 of the present invention. Referring to FIG. 10, the forcible braking switch 26 is provided between the second brake coil 18 and the power supply 19. The forcible braking switch 26 is normally closed. By opening the forcible braking switch 26, the second brake portion body 9 is forced to perform braking operation regardless of a command from the brake control portion 23. Embodiment 10 of the present invention is identical to Embodiment 9 of the present invention in other configurational details and other operational details.

In the elevator apparatus structured as described above, the forcible braking switch 26 is provided between the second brake coil 18 and the power supply 19. It is therefore possible to invalidate the control performed by the brake control portion 23 according to need.

In Embodiment 10 of the present invention, it is also appropriate to input a brake actuation command to the brake control portion 23, and allow the brake control portion 23 to control the deceleration of the car 1 only when the brake actuation command is generated.

Further, although the brake control portion 23 is constituted by the computer in the foregoing examples, an electric circuit for processing analog signals may be employed to constitute the brake control portion 23.

Still further, although the brake device is provided on the hoisting machine 4 in the foregoing examples, it is also appropriate to provide the brake device at another position. That is, the brake device may be a car brake mounted on the car 1, a rope brake for gripping the main rope 3 to brake the car 1, or the like.

Yet further, the brake rotational body is not limited to the brake drum 7. For example, the brake rotational body may be a brake disc.

Further, three or more brake portion bodies may be provided for a single brake rotational body.

Still further, the brake device is disposed outside the brake rotational body in the foregoing examples. However, the brake device may be disposed inside the brake rotational body.

Yet further, the brake rotational body may be integrated with the drive sheave 5.

The invention claimed is:

1. An elevator apparatus, comprising:

a car; and a brake device for stopping the car from running, wherein the brake device has a brake control portion for controlling a braking force generated at a time of emergency braking to adjust a deceleration of the car; and a timer circuit for invalidating control of the braking force performed by the brake control portion after a lapse of a predetermined time from a moment when an emergency braking command is generated.

2. The elevator apparatus according to claim 1, wherein:

the brake device has:

a brake shoe that is moved into contact with and away from a brake rotational body that is rotated as the car runs;

a braking spring for pressing the brake shoe against the brake rotational body; and a brake coil for generating an electromagnetic force for opening the brake shoe away from the brake rotational body against the braking spring;

the brake control portion controls the electromagnetic force generated by the brake coil at the time of emergency braking; and the timer circuit shuts off supply of a power to the brake coil after the lapse of the predetermined time from the moment when the emergency braking command is generated.

3. The elevator apparatus according to claim 2, wherein the brake device further has a current limiter for limiting a current flowing through the brake coil.

4. The elevator apparatus according to claim 1, further comprising an operation control portion for controlling operation of the car, wherein the brake control portion detects a deceleration of the car independently of the operation control portion.

5. The elevator apparatus according to claim 1, wherein the brake device has a forcible braking switch for invalidating the control of the braking force performed by the brake control portion in response to an external signal to forcibly cause generation of a total braking force.

* * * * *